US007117998B2

(12) United States Patent
Krapf

(10) Patent No.: US 7,117,998 B2
(45) Date of Patent: Oct. 10, 2006

(54) GRAPHIC MEDIA MATERIALS CARRIER

(76) Inventor: Wallace A. Krapf, 1933 O'Neill Rd., Macedon, NY (US) 14502

( * ) Notice: Subject to any disclaimer, the term of this patent is extended or adjusted under 35 U.S.C. 154(b) by 214 days.

(21) Appl. No.: 10/732,662

(22) Filed: Dec. 10, 2003

(65) Prior Publication Data

US 2005/0127013 A1 Jun. 16, 2005

(51) Int. Cl.
*G09F 1/10* (2006.01)
*A47F 5/08* (2006.01)

(52) U.S. Cl. ..... 211/45; 211/41.13; 211/46; 211/55; 211/94.01; 211/162; 40/124; 40/124.05; 40/124.2; 40/649; 40/654.01; 40/661; 40/735

(58) Field of Classification Search ..... 211/42, 211/45, 41.13, 94.01; 40/700, 360, 5, 674, 40/492, 530, 124.05, 124.06, 649, 654.01, 40/124.191, 735, 124, 124.2, 661; 52/588.1, 52/36.1, 36.4, 29, 33, 38, 40
See application file for complete search history.

(56) References Cited

U.S. PATENT DOCUMENTS 534,157 A * 2/1895 Jones ..... 40/124.06
1,062,020 A * 5/1913 MacOrquodale ..... 40/124.06
2,051,677 A * 8/1936 Brodsky ..... 40/124
2,886,907 A * 5/1959 Stephenson ..... 40/124.2
3,795,071 A * 3/1974 Wagner ..... 40/611.12
4,312,393 A * 1/1982 Green ..... 281/45
4,475,659 A * 10/1984 Wells et al. ..... 211/55
4,944,416 A * 7/1990 Petersen et al. ..... 52/36.5
5,259,517 A * 11/1993 Pancoe ..... 211/46
5,284,256 A * 2/1994 Correll-Antoun ..... 211/42
5,339,547 A * 8/1994 Fogel ..... 40/124.01
5,857,578 A * 1/1999 Fishman ..... 211/189
6,443,317 B1 * 9/2002 Brozak, Jr. ..... 211/85.1
6,467,637 B1 * 10/2002 Riga ..... 211/94.01
6,568,114 B1 * 5/2003 Klukan ..... 40/733
6,665,970 B1 * 12/2003 Yun ..... 40/661
2004/0055187 A1 * 3/2004 Kerker et al. ..... 40/124

* cited by examiner

*Primary Examiner*—Richard E. Chilcot, Jr.
*Assistant Examiner*—Jared W. Newton
(74) *Attorney, Agent, or Firm*—Peter J. Bilinski

(57) ABSTRACT

A carrier for supporting graphic media materials includes a support member having a plurality of parallel transverse slots disposed on a facing surface thereof and a plurality of thin walled transverse strip members. Each of the transverse strip members are made from a flexible material and include an angled tab portion sized to be fitted into a corresponding slot of the support member and a cover portion that is defined by a width dimension that is larger than the spacing between adjacently spaced slots such that the cover portions are arranged on the support member in overlaying fashion and define transparent storage pockets therebetween for retaining graphic media materials.

40 Claims, 5 Drawing Sheets

GRAPHIC MEDIA MATERIALS CARRIER

FIELD OF THE INVENTION

The invention pertains to the field of graphic media material carriers and more specifically to a carrier for permitting photographs and/or other graphic media materials to be selectively and conveniently stored for display.

BACKGROUND OF THE INVENTION

There are various carriers that are commonly known in the field for retaining and storing a plurality of various graphic media materials, such as photographs, articles, and the like. Most common among these types of carriers are photograph or picture albums, each having a series of pages, with various sized pockets or other means for securing a photograph or several photographs for storage and display thereof.

Though these types of carriers are very useful, there are often events in which a plurality of photographs are taken, such as social gatherings, including bowling parties, golf tournaments, weddings, funerals, and the like in which it is often desirable to display a plurality of photographs and/or other graphic media materials simultaneously. To date, Applicant believes that a carrier suitable for this purpose has not yet been developed.

SUMMARY OF THE INVENTION

It is a primary object of the present invention to address the above-noted deficiencies of the prior art.

It is another primary object of the present invention to provide a graphic media materials carrier that permits a plurality of photographs or other forms of graphic media materials to be retained and displayed in a limitless variety of configurations and/or arrangements.

Therefore and according to a preferred aspect of the present invention, there is provided a carrier for supporting graphic media materials, said carrier comprising:

- a rectilinear support member, said support member including a plurality of parallel transverse slots disposed on a facing surface thereof; and
- a plurality of thin-walled angled transverse strip members, each of said strip members being made from a highly flexible material, said strip members each including a tab portion sized to be fitted into a corresponding slot of said support member and a cover portion defined by a height that is larger than the spacing between adjacently spaced slots of said support member such that said cover portions are arranged on said support member in overlaying fashion.

Preferably, the cover members are made from a transparent plastic material such that graphic media materials added into pockets defined between adjacent cover portions can be conveniently stored and displayed.

Preferably, the cover members used by the carrier include an angled surface such that a covering portion thereof is caused to bias inwardly toward the support member and against the material being retained. Alternately, the slots can be angled to provide the desired biasing.

A frame means is further provided on at least a portion of the periphery of the support member in order to effectively retain the cover members once attached thereto. The frame means can include adhesives or can include structural components, including snap-fitted or fastening portions that can be integrally attached or as part of an assembly.

The carrier can be provided as a single section or as multiple sections that can be, for example, hingably connected together to form a display system. Numerous variations and configurations are possible.

According to another preferred aspect of the present invention, there is provided a graphic materials display system comprising:

- a base;
- a support member attached to said base, said support member including a plurality of panels arranged in a cubic-like configuration in which a bottom surface of said support member is affixed to said base, said support member including a plurality of side panels in which at least one of said side panels includes:
- a rectilinear support member having a plurality of parallel transverse slots cut into a facing surface thereof; and
- a plurality of thin-walled transverse strip members, each of said strip members being made from a highly flexible material and including an angled tab portion sized to be fitted into a slot of said support member and a cover portion having a height dimension that is larger than the spacing between a pair of adjacent slots wherein said strip members are arranged on the facing surface of said support member in overlaying fashion and include pockets therebetween for retaining graphic media materials.

According to yet another preferred aspect of the present invention, there is described a method for manufacturing a graphic media carrier, said method comprising the steps of:

- creating a series of parallel transverse spaced slots into a facing surface of at least one planar support member;
- inserting an angled tab portion of a flexible thin-walled transverse strip member into a first slot of said planar support member, said strip member including a transparent cover portion covering a portion of said support member, said cover portion having a height that is larger than the spacing between a pair of adjacent slots;
- attaching additional strip members onto said support member by inserting corresponding angled tab portions of each into adjacent slots on said support member thereby forming an overlapping arrangement including pockets for retaining graphic media material.

An advantage provided by the present invention is that a plurality of photographs or other graphic media materials can be effectively and efficiently stored in a manner that permits the photographs to be retained for display, but in which retention thereof does not unnecessarily add to the length or overall size of the display area of the carrier.

Another advantage provided by the present invention is that the carriers described herein can be easily manufactured at a relatively low cost and can be easily utilized in a nearly limitless variety of different applications and uses.

Still another advantage realized by the present invention is that the carriers described herein can be added to or incorporated into an effective display system, enabling a plurality of different graphic media materials to be displayed simultaneously.

These and other objects, features, and advantages will become readily apparent from the following Detailed Description which should be read in conjunction with the accompanying drawings.

BRIEF DESCRIPTION OF THE DRAWINGS

Reference is now made to the figures listed below wherein.

DETAILED DESCRIPTION

Figure 1:
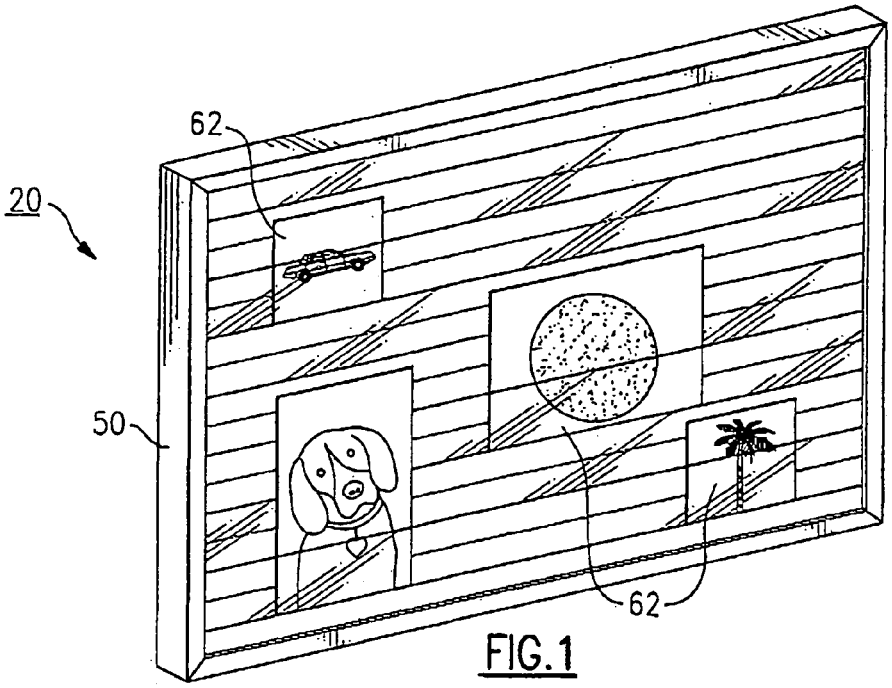
FIG. 1 is a top perspective view of a graphic media materials carrier that is made in accordance with a first preferred embodiment of the present invention.
Figure 2:
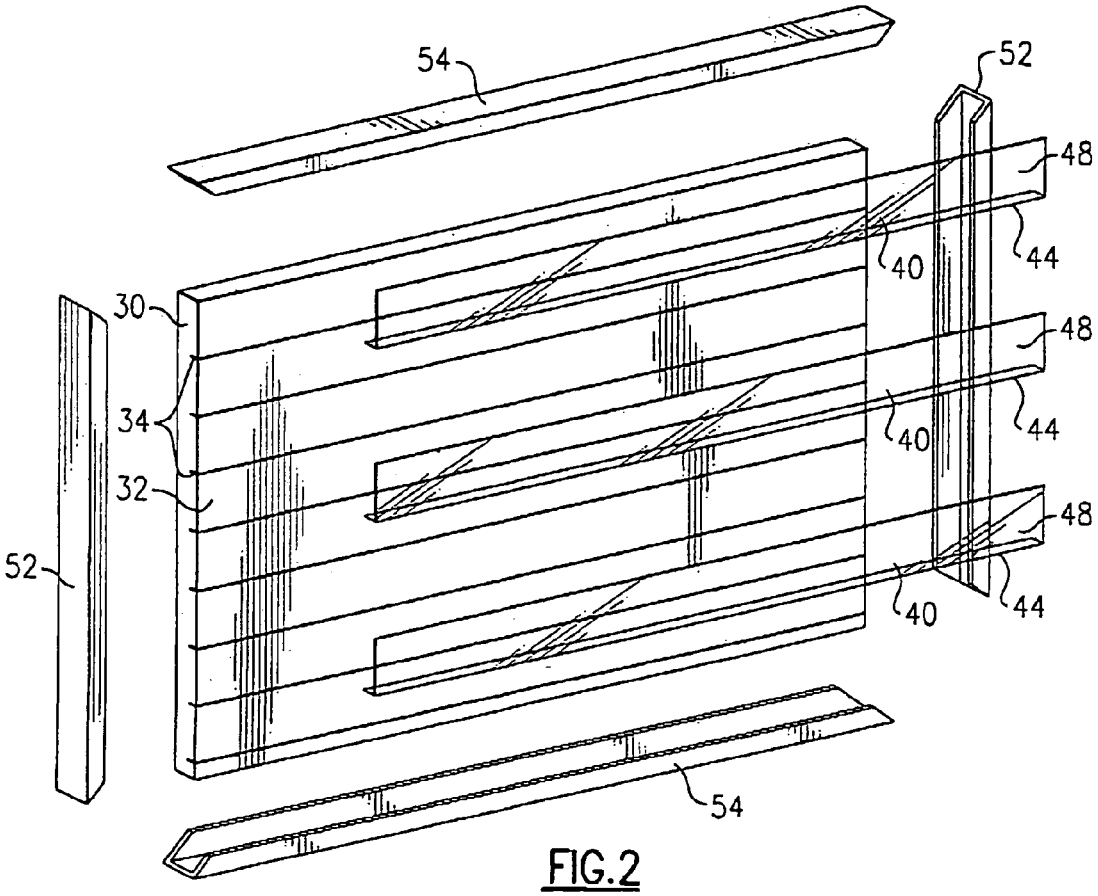
FIG. 2 is an exploded view of the graphic media materials carrier of FIG. 1.

The following description relates to certain embodiments and uses/applications for a graphic media materials carrier that can be manufactured in accordance within the tenets of the present invention. To those of sufficient skill in the field, it will be readily apparent that there are numerous other variations and modifications that can embody the inventive concepts discussed herein. In addition and throughout the course of this discussion, several terms are frequently used including "top", "bottom", "lateral", "upper", "lower" and the like which are used in order to provide a frame of reference with regard to the accompanying drawings. These terms, however, are not in any way intended to be limiting of the present invention as claimed herein and should therefore not be viewed as limiting, except where specifically indicated. Turning to FIGS. 1 and 2, there is shown a graphic media materials carrier 20 that is made in accordance with a first embodiment of the invention. The graphic media materials carrier 20 is defined by a planar supporting member 30, a frame 50 and a plurality of transverse strip members 40 that are used to support a plurality of graphic media materials, such as, for example, photographs 62, as shown only in FIG. 1. Additional detail is now provided for each of the above-enumerated components of the carrier 20, as follows.

Still referring to FIGS. 1 and 2, the planar supporting member 30 is defined by a sufficiently rigid, though preferably a suitably lightweight material, such as foam, plastic or other material and includes a top or upper facing surface 32 having a series of parallel longitudinal slots 34 that have been cut at least partially into the surface. Each of the slots 34 are preferably, though not necessarily, equally spaced from one another and extend transversely relative to the major dimension (in this case, the length) of the member. It should be noted in passing however, that the shape of the member, though rectilinear according to this embodiment, can assume square, rounded, or other suitable shapes and that the invention is herein therefore not particularly limited to a specific configuration. According to this particular embodiment, the transverse slots 34 are equally spaced from one another approximately 1.25 inches, though this parameter can be varied easily depending on the application or intended use of the carrier 20, and the size of supporting pocket/materials that may be required for display.

Figure 3:
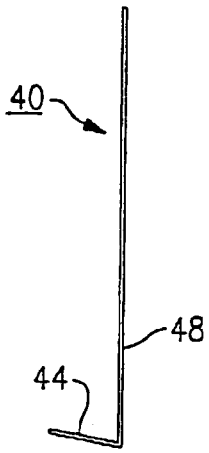
FIG. 3 is a side view of a strip member used in the graphic media materials carrier of FIGS. 1 and 2.

Referring to FIGS. 1–3, the transverse strip members 40 used in conjunction with the carrier 20 are flat, elongate, substantially L-shaped sections that are fabricated preferably from a transparent lightweight plastic material, such as, for example, a rigid vinyl. Each of the cover members 40 are defined by an engagement or supporting portion 44 and a cover portion 48. Preferably, the supporting portion 44 and the cover portion 48 are angled relative to one another, as shown in FIG. 3, to substantially form an L-shape with the cover portions having a length that is substantially larger than the spacing between the slots 34 of the planar supporting member 30, for reasons that are described in greater detail below. According to this specific embodiment, the length of each of the cover portions 48 is approximately 1.875 inches, thereby providing an excess length relative to the spacing between adjacent longitudinal slots 34 of approximately 0.625 inches.

Figure 4:
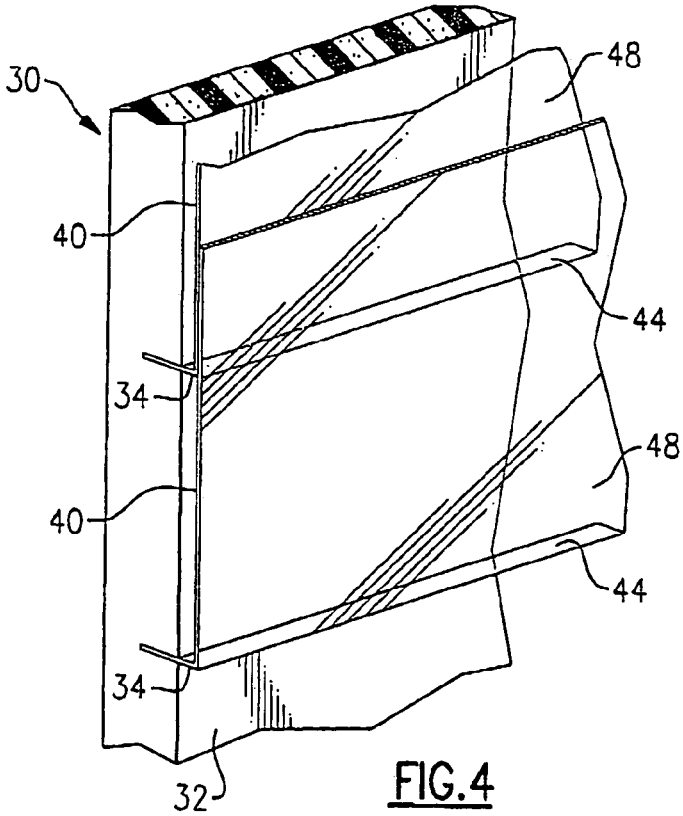
FIG. 4 is a partial assembly view of the graphic media materials carrier of FIGS. 1 and 2, illustrating the assembly of a cover member to the top facing side of the carrier.

Preferably and referring to FIG. 4, the supporting portion 44 of each strip member 40 is inserted into a corresponding slot 34 of the facing surface 32 of the planar supporting member 30 such that the cover portion 48 extends along an axial portion of the facing surface 32 in a direction extending "above" the slot 34. Preferably as shown in FIGS. 3 and 4, the supporting portion 44 is not bent orthogonally relative to the cover portion 48, but rather is set at a slightly obtuse angle, such that upon insertion into the slot 34 that the cover portion is angled slightly inwardly toward the facing surface 32 of the planar supporting member 30.

Figure 5:
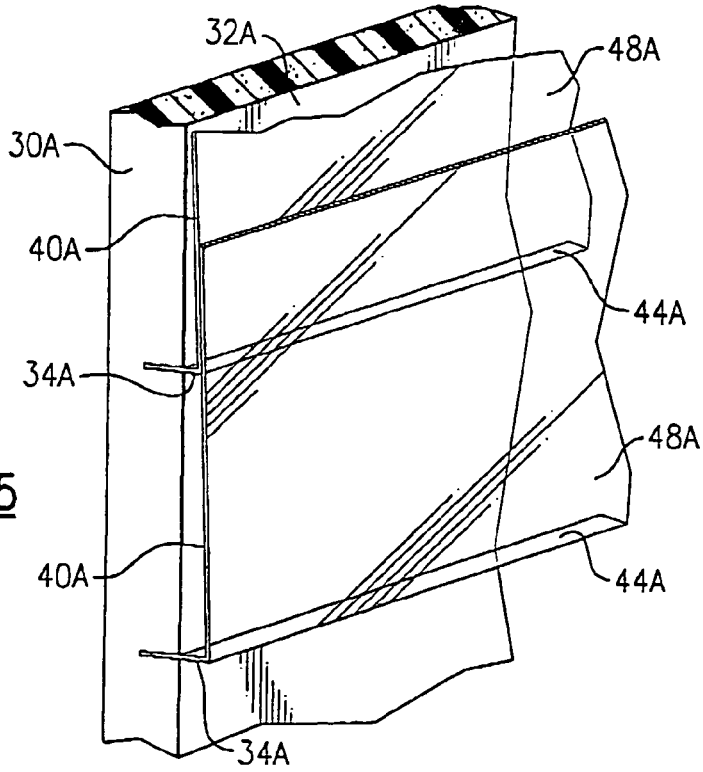
FIG. 5 is the partial assembly view of FIG. 4 including a graphic media materials carrier and a corresponding cover member that are made in accordance with another preferred embodiment of the present invention.

Alternately and according to FIG. 5, the strip member 40A can assume a substantially orthogonal configuration between the cover portion 48A and the engagement portion 48A with the slot 34A being angled relative to the plane defined by the facing surface 32A of the planar supporting member 30A.

The frame 50 of the herein-described carrier 20 is attached to the edges of the planar supporting member 30 and forms a peripheral border about the carrier 20. The frame 50 can be defined by a single unitary section (not shown) or alternately can be fabricated from sections 52, 54 that are fitted about the outer periphery of the planar supporting member 30, using fasteners or other conventional means (not shown).

Referring to FIGS. 1–4, and to assemble the herein described graphic media materials carrier 20, the slots 34 are first cut into the top facing surface 32 of the planar supporting member 30. As noted, the slots 34 are preferably equally spaced, but can have variable spacing depending on the application of the carrier 20, including those graphic media materials to be stored and displayed.

Preferably and starting with the uppermost slot 34, a transverse strip member 40 is assembled by placing the engagement portion 44 thereof into the slot with the cover portion 48 of the member facing upwardly relative to the slot. Additional strip members 40 are then subsequently added to the assembly and the frame 50 is attached once all of the cover members have been secured to the supporting member 30. An adhesive (not shown) can be used to affix each strip member 40 once secured within the slot 34.

Figure 6:
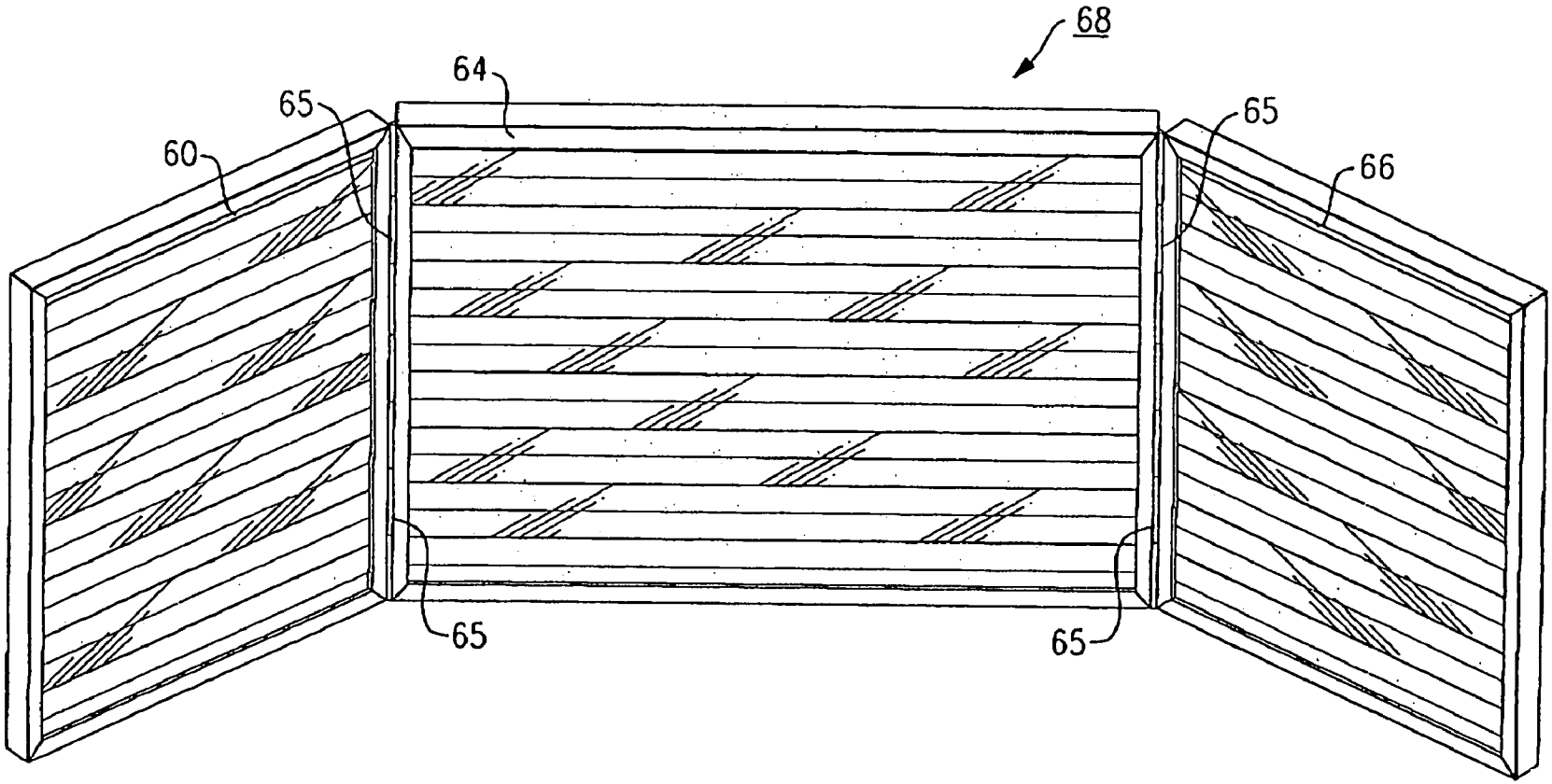
FIG. 6 is a front perspective view of a graphic media materials carrier made in accordance with a third preferred embodiment of the present invention.

It should be pointed out that the carriers shown herein can be used for various applications. For example, and referring to FIG. 6, a series of carriers 60, 64, 66 can be attached by hinges 65 together laterally to form a foldable compact assembly 68 defined herein as a third embodiment of the invention. Identifying labels (not shown) can be used on either the cover portions 48 or the supporting member 30, for example, to better identify certain media materials or alternately to label the theme of the displayed materials.

Figure 7:
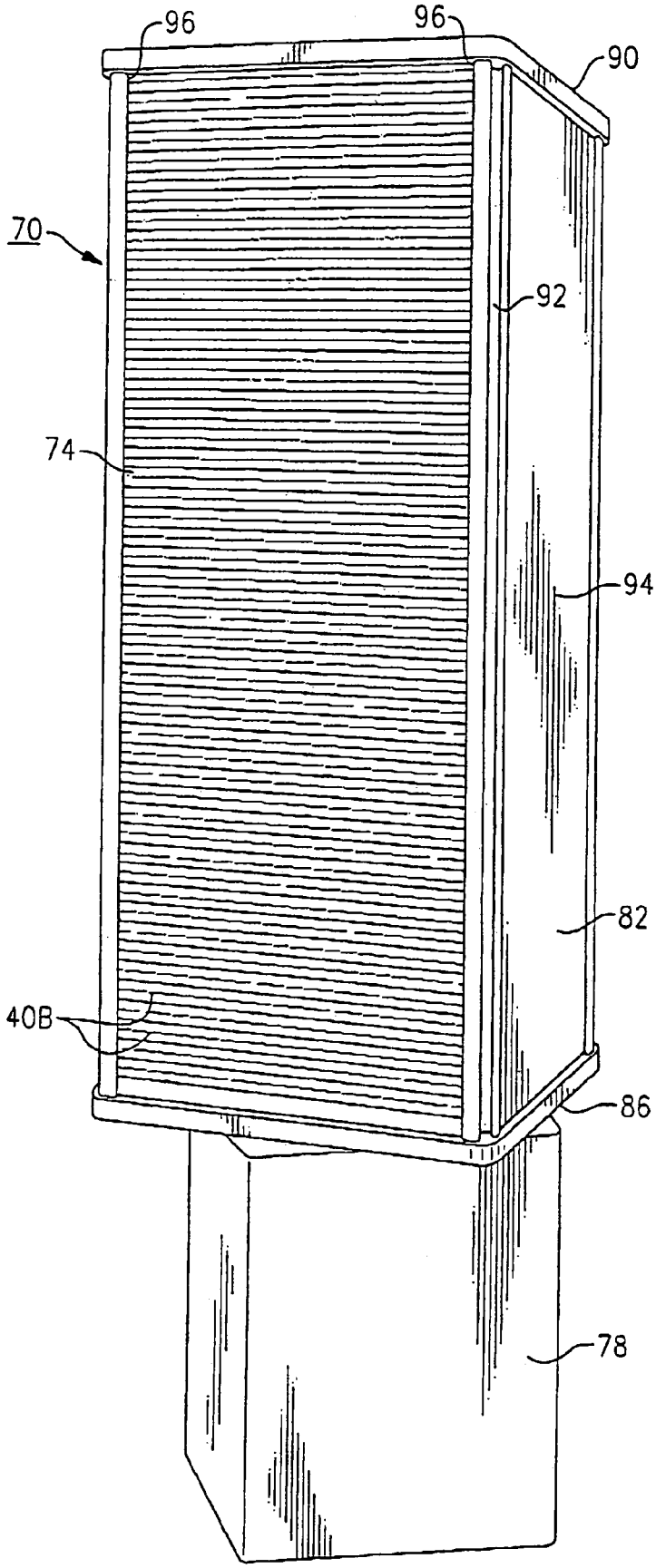
FIG. 7 depicts a front view of a display system including a graphic media materials carrier made in accordance with the present invention.

According to FIG. 7, a graphic display system 70 incorporating a graphic media materials carrier 74 includes a rotatable kiosk that includes a base 78 and a cube-like carrier 82 defined by a bottom surface 86, a top surface 90 and a plurality of laterally extending side panels 94; The side panels 94 of the cube-like carrier 82 are attached to one another by means of vertically extending supports 92 provided at each corner thereof, each of the supports including a slot 96 sized to receive an end of the panel. The bottom surface 86 of the cube-like carrier 82 is preferably rotatably attached, such as by means of a turntable (not shown) to the top of the base 78 to enable any of the side panels 94 to be viewed as needed.

At least one of the panels 94 of the cube-like carrier 82 can include a graphic media materials carrier 74 that is fabricated in the manner described by the preceding; that is, including a planar supporting member having a plurality of transverse slots and a corresponding plurality of transverse strip members 40B that are secured within the slots creating pockets for retaining a plurality of graphic media materials such as photographs and the like.

Figure 8:
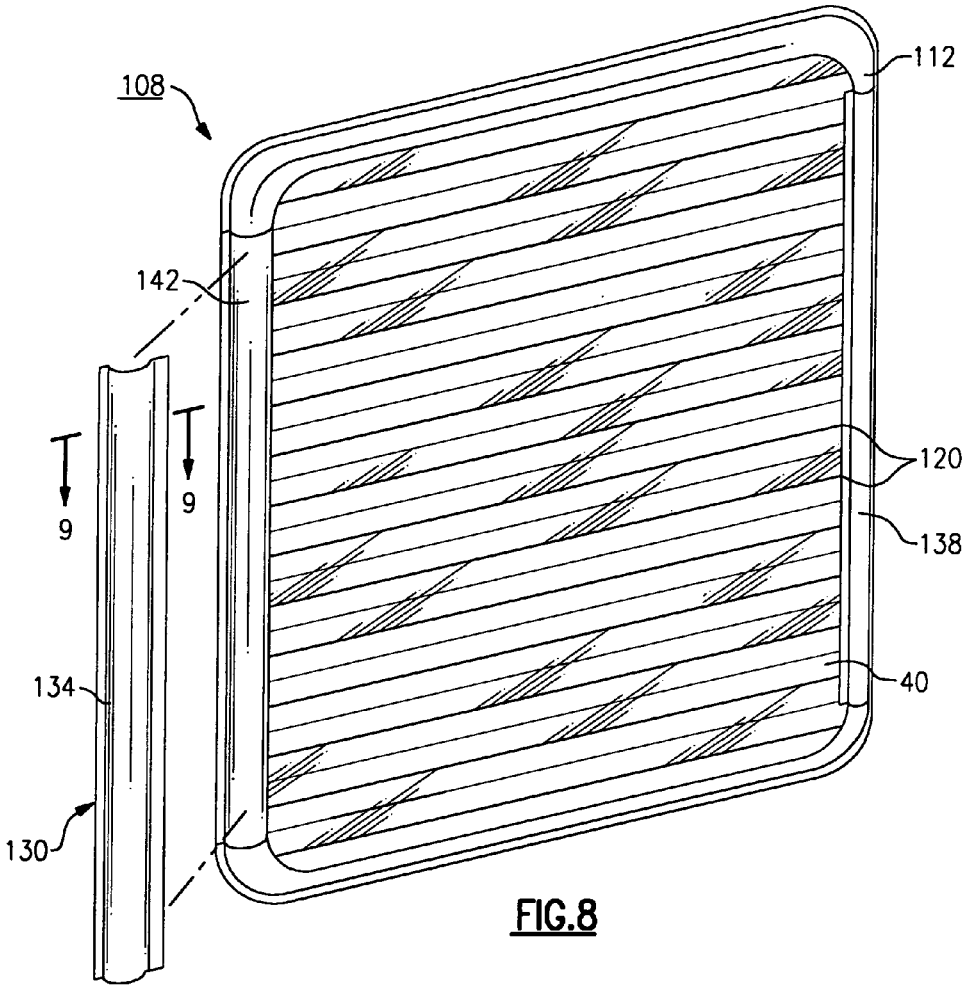
FIG. 8 is a top perspective view of a graphic media materials carrier made in accordance with a fourth preferred embodiment of the present invention.
Figure 9:
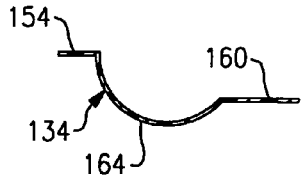
FIG. 9 is a sectioned view of a lateral frame member of the graphic media materials carrier of FIG. 8, as taken through lines 9—9.

A graphic media materials carrier 108 made in accordance with a fourth preferred embodiment of the present invention is illustrated in FIGS. 8 and 9. According to this embodiment, the carrier 108 includes a rectilinear, vacuum-formed plastic supporting member 112, preferably having a paper or cardboard backing layer (not shown) defining an extremely light and low profile design. The top or facing surface 116 of the supporting member 112 is planar and includes a plurality of slots 120 that extend transversely relative to the major dimension (the length) of the member and are preferably equally spaced relative to one another. The slots 120 are used to support a plurality of transparent plastic strip members 40, such as those previously described, each of which include a tab portion 44, FIG. 3, and a cover portion 48, FIG. 3, thereby defining a substantially angled L-shape and in which each of the cover members have a length that substantially at least spans the width of the planar supporting member 112 and a width that extends a distance that is greater than the spacing between the transverse slots to define a series of transparent supporting pockets for retaining graphic media materials.

According to this embodiment, a snap fitting frame 130 is used in conjunction with the plastic supporting member 112 in order to effectively secure the ends of each of the cover members 40 to the carrier 108. The frame 130 includes pair of lateral frame sections 134, 138 that are mounted in overlaying relation onto curved portions 142 that are already provided on the periphery of the plastic supporting member 112. Adhesive (not shown) can also be used to secure each of the strip members' attachment within a slot 120.

As shown more clearly in FIG. 9, each lateral frame section (only section 134 is shown for the sake of convenience) is contoured to fit the exterior of the periphery of the facing surface of the supporting member 112. In this instance, the supporting member 112 includes a horizontal edge surface 146 as well as a raised edge surface (not shown) that is also horizontal and parallel with the horizontal edge surface. The interior edge surface is substantially planar to the facing surface supporting the strip members 40 with the curved portion 142 being disposed between the interior edge surface and the horizontal edge surface 146. In terms of the frame section 134, FIG. 9, complementary edge surfaces 154, 160, and radiused surface 164 are each provided that follow the contour of the periphery of the supporting member 112. Preferably, each frame portion 134, 138 and the supporting member 112 are each made from plastic wherein the components are matched to provide a snap fit when the frame portions are attached onto the periphery of the supporting member.

It should be noted that other variations to the above frame could be utilized depending on the shape of the support member. For example, the periphery of the support member could include undercuts (not shown) in lieu of outwardly curved portions for supporting each of the transverse strip members. In this instance, therefore, a separate frame portion would not be needed.

PARTS LIST FOR FIGS. 1–9

20 graphic media materials carrier
30 planar supporting member
30A planar supporting member
32 facing surface
32A facing surface
34 transverse slots
34A slots
40 cover members
40A cover member
40B cover member
44 tab or engagement portion
44A engagement portion
48 covering portion
48A covering portion
50 frame
52 frame portion
54 frame portion
60 carrier
62 photographs
64 carrier
65 hinges
66 carrier
68 assembly
70 graphic display system
78 base
82 cube-like carrier
86 bottom surface
90 top surface
92 vertically extending supports
94 panels
96 slot
108 carrier
112 plastic supporting member
116 top facing surface
120 slots
130 snap-fitting frame
134 lateral frame section
138 lateral frame section
142 curved portions
146 horizontal edge surface
154 edge surface
160 edge surface
164 radiused surface It should be readily apparent that there are certain variations and modifications within the intended scope of the present invention as described herein and according to the following enumerated claims.

I claim:

1. A carrier for supporting graphic media materials, said carrier comprising:

a planar support member, said planar support member including a plurality of parallel transverse slots disposed in a top facing surface thereof;

a plurality of thin walled transverse substantially L-shaped strip members, each of said substantially L-shaped strip members being made from a flexible transparent material, said strip members each consisting essentially of an engagement portion sized to be fitted into a corresponding slot of said support member and a cover portion extending above said slot, each said cover portion having a height dimension that is larger than the spacing between adjacently spaced slots such that said plurality of cover portions are arranged on said support member in overlaying fashion and define a plurality of storage pockets between adjacent cover portions for retaining graphic media materials, wherein said graphic media materials are retained between said cover portions, each of said cover portions being attached to a said slot to cause said cover portion to inwardly flex toward said top facing surface wherein each said engagement portion is angled substantially orthogonal relative to the cover portion of a said strip member, said slots being angled to cause said cover portion to flex inwardly toward said top facing surface.

2. A carrier as recited in claim 1, including a frame for retaining edges of said cover members onto said support member.

3. A carrier as recited in claim 2, wherein said frame includes at least one snap-fitting member contoured to fit with a peripheral portion of said support member.

4. A carrier as recited in claim 2, wherein the top facing surface of said support member is black in color.

5. A carrier as recited in claim 1, wherein the top facing side of said support member is painted.

6. A carrier as recited in claim 1, wherein the support member is made from a lightweight foam material.

7. A carrier as recited in claim 1, wherein said plurality of transverse slots are evenly spaced from one another.

8. A carrier as recited in claim 1, wherein the spacing between said transverse slots is varied to permit strip members having cover portions having differing height dimensions to be used therewith.

9. A carrier as recited in claim 1, including at least one label removably attachable to said one of said support members and at least one strip member for identifying graphic media material placed on said cover.

10. A carrier as recited in claim 1, including means for interconnecting at least one additional carrier thereto.

11. A carrier as recited in claim 10, wherein said interconnecting means includes hinges.

12. A carrier for supporting graphic media materials, said carrier comprising:

a planar support member, said planar support member including a plurality of parallel transverse slots disposed in a top facing surface thereof;

a plurality of thin walled transverse substantially L-shaped strip members, each of said substantially L-shaped strip members being made from a flexible transparent material, said strip members each consisting essentially of an engagement portion sized to be fitted into a corresponding slot of said support member and a cover portion extending above said slot, each said cover portion having a height dimension that is larger than the spacing between adjacently spaced slots such that said plurality of cover portions are arranged on said support member in overlaying fashion and define a plurality of storage pockets between adjacent cover portions for retaining graphic media materials, wherein said graphic media materials are retained between said cover portions, each of said cover portions being attached to a corresponding slot to cause said cover portion to inwardly flex toward said top facing surface, wherein each said engagement portion is angled relative to a corresponding cover portion of each strip member such that said cover portion is flexed toward said top facing surface of said support member when said engagement portion is inserted into a said slot.

13. A carrier as recited in claim 12, including a frame for retaining edges of said cover members onto said support member.

14. A carrier as recited in claim 13, wherein said frame includes at least one snap-fitting member contoured to fit with a peripheral portion of said support member.

15. A carrier as recited in claim 13, wherein the top facing surface of said support member is black in color.

16. A carrier as recited in claim 12, wherein the top facing side of said support member is painted.

17. A carrier as recited in claim 12, wherein the support member is made from a lightweight foam material.

18. A carrier as recited in claim 12, wherein said plurality of transverse slots are evenly spaced from one another.

19. A carrier as recited in claim 12, wherein the spacing between said transverse slots is varied to permit strip members having cover portions having differing height dimensions to be used therewith.

20. A carrier as recited in claim 12, including at least one label removably attachable to said one of said support members and at feast one strip member for identifying graphic media material placed on said cover.

21. A carrier as recited in claim 12, including means for interconnecting at least one additional carrier thereto.

22. A carrier as recited in claim 21, wherein said interconnecting means includes hinges.

23. A graphic display system comprising:

a base;

a support member attached to said base, said support member including a plurality of panels arranged in a box-like configuration in which a bottom surface of said support member is affixed to said base, said support member including a plurality of side panels in which at least one of said side panels includes:

a rectilinear support member having a plurality of parallel transverse slots cut into a facing surface thereof; and a plurality of thin-walled substantially L-shaped transverse strip members, each of said strip members being made from a flexible material and consisting essentially of an engagement portion sized to be fitted into a slot of said support member and a cover portion extending above said slot when fitted therein, each said cover portion having a height dimension that is larger than the spacing between a pair of adjacent slots wherein said cover portions are arranged on the facing surface of said support member in overlaying fashion and define a plurality of storage pockets between adjacent cover portions for retaining graphic medic materials, each said defined storage pocket including a pair of cover portions wherein graphic media materials are retained by and between said cover portions, wherein each said engagement portion is angled substantially orthogonal relative to the cover portion of a said strip member, said transverse slots being angled to cause each said cover portion to flex inwardly toward said facing surface.

24. A system as recited in claim 23, wherein said cover portions are made from a transparent material.

25. A system as recited in claim 24, wherein said facing surface is black.

26. A system as recited in claim 23, including a frame for retaining edges of said strip members onto said support member.

27. A system as recited in claim 23, wherein said support member is fabricated from a lightweight foam material.

28. A graphic display system comprising:

a base;

a support member attached to said base, said support member including a plurality of panels arranged in a box-like configuration in which a bottom surface of said support member is affixed to said base, said support member including a plurality of side panels in which at least one of said side panels includes:

a rectilinear support member having a plurality of parallel transverse slots cut into a facing surface thereof; and a plurality of thin-walled substantially L-shaped transverse strip members, each of said strip members being made from a flexible material and consisting essentially of an engagement portion sized to be fitted into a slot of said support member and a cover portion extending above said slot when fitted therein, each said cover portion having a height dimension that is larger than the spacing between a pair of adjacent slots wherein said cover portions are arranged on the facing surface of said support member in overlaying fashion and define a plurality of storage pockets between adjacent cover portions for retaining graphic medic materials, each said defined storage pocket including a pair of cover portions wherein graphic media materials are retained by and between said cover portions, wherein the engagement portions of said strip members are angled relative to said cover portions such that the cover portion of a said strip member is flexed toward said facing surface of said support member when said a strip member is inserted into a corresponding transverse slot.

29. A system as recited in claim 28, wherein said cover portions are made from a transparent material.

30. A system as recited in claim 29, wherein said facing surface is black.

31. A system as recited in claim 28, including a frame for retaining edges of said strip members onto said support member.

32. A system as recited in claim 28, wherein said support member is fabricated from a lightweight foam material.

33. A method for manufacturing a graphic media carrier, said method comprising the steps of:

cutting a series of parallel transverse spaced slots into a facing surface of a planar support member;

inserting an engagement portion of a flexible thin-walled substantially L-shaped transverse strip member into a first transverse slot of said planar support member, said strip member consisting essentially of said engagement portion and a transparent cover portion that extends above said slot when said strip member is inserted into said slot and covering a portion of said support member, said cover portion having a height dimension that is larger than the spacing between a pair of adjacent slots;

attaching additional strip members onto said support member by inserting corresponding engagement portions of each strip member into adjacent transverse slots on said support member thereby forming an overlapping arrangement of cover portions between adjacent cover portions including storage pockets for retaining graphic media material, each said storage pocket defined by a pair of cover portions wherein graphic media materials are retained therebetween, wherein each said engagement portion is angled substantially orthogonal relative to the cover portion of each said strip member, said transverse slots being angled to cause each said cover portion to flex inwardly toward said top facing surface.

34. A method as recited in claim 33, including the step of providing a frame on the periphery of said support member.

35. A method as recited in claim 33, wherein said frame providing step includes the step of snap-fitting at least one frame member onto a portion of the periphery of said support member.

36. A method as recited in claim 33, including the step of placing at least one label on at least one of said support member and at least one strip member for identifying displayed materials.

37. A method for manufacturing a graphic media carrier, said method comprising the steps of:

cutting a series of parallel transverse spaced slots into a facing surface of a planar support member;

inserting an engagement portion of a flexible thin-walled substantially L-shaped transverse strip member into a first slot of said planar support member, said strip member consisting essentially of said engagement portion and a transparent cover portion that extends above said slot when said strip member is inserted into said slot and covering a portion of said support member, said cover portion having a height dimension that is larger than the spacing between a pair of adjacent slots;

attaching additional strip members onto said support member by inserting corresponding engagement portions of each strip member into adjacent transverse slots on said support member thereby forming an overlapping arrangement of cover portions between adjacent cover portions including storage pockets for retaining graphic media material, each said storage pocket defined by a pair of cover portions wherein graphic media materials are retained therebetween, wherein each said engagement portion is angled relative to a corresponding cover portion of said strip member such that said cover portion is flexed toward said facing surface of said support member when said engagement portion is inserted into a said slot.

38. A method as recited in claim 37, including the step of providing a frame on the periphery of said support member.

39. A method as recited in claim 37, wherein said frame providing step includes the step of snap-fitting at least one frame member onto a portion of the periphery of said support member.

40. A method as recited in claim 37, including the step of placing at least one label on at least one of said support member and at least one strip member for identifying displayed materials.

* * * * *